US009744682B2

(12) United States Patent
Bellamy

(10) Patent No.: US 9,744,682 B2
(45) Date of Patent: Aug. 29, 2017

(54) HEATED UTILITY KNIFE

(71) Applicant: GRAND PRODUCTS, LLC, Middlebury, IN (US)

(72) Inventor: Brandon Bellamy, Warsaw, IN (US)

(73) Assignee: Grand Products, LLC, Middlebury, IN (US)

( * ) Notice: Subject to any disclaimer, the term of this patent is extended or adjusted under 35 U.S.C. 154(b) by 209 days.

(21) Appl. No.: 14/043,526

(22) Filed: Oct. 1, 2013

(65) Prior Publication Data

US 2014/0096658 A1 Apr. 10, 2014

Related U.S. Application Data

(60) Provisional application No. 61/709,590, filed on Oct. 4, 2012.

(51) Int. Cl.

| | |
|---|---|
| ***B26B 1/08*** | (2006.01) |
| ***B26D 7/10*** | (2006.01) |
| ***B26B 13/22*** | (2006.01) |
| ***B26B 5/00*** | (2006.01) |

(52) U.S. Cl.

CPC ..... *B26D 7/10* (2013.01); *B26B 1/08* (2013.01); *B26B 5/001* (2013.01); *B26B 13/22* (2013.01); *Y10T 83/283* (2015.04)

(58) Field of Classification Search

CPC .. B26B 3/00; B26B 1/08; B26B 5/001; Y10T 408/44; Y10T 83/283; F23D 14/28; F23D 14/38; B26D 7/10

USPC ..... 83/16, 170; 431/153; 30/153–154, 30/160–163

See application file for complete search history.

(56) References Cited

U.S. PATENT DOCUMENTS

| | | | | |
|---|---|---|---|---|
| 6,213,759 | B1 | 4/2001 | Sung | |
| 6,553,674 | B1 * | 4/2003 | Budrow | 30/162 |
| 7,563,094 | B2 * | 7/2009 | Yang | F23Q 3/002 431/153 |
| 2005/0204563 | A1 * | 9/2005 | Stender | 30/123 |
| 2007/0068003 | A1 | 3/2007 | Schmidt | |
| 2009/0098494 | A1 * | 4/2009 | Aronson et al. | 431/153 |

FOREIGN PATENT DOCUMENTS

| | | | |
|---|---|---|---|
| DE | 10259995 | A1 | 7/2004 |
| FR | 2653150 | B1 | 4/1991 |
| GB | 986162 | A | 3/1965 |

* cited by examiner

*Primary Examiner* — Ghassem Alie
*Assistant Examiner* — Nhat Chieu Do
(74) *Attorney, Agent, or Firm* — Elana A. Bertram, Esq.

(57) ABSTRACT

A heated utility knife is disclosed for heating a material to be cut in order to soften the material before cutting the material. The heated utility knife is made of a knife portion that has a blade with a distal cutting edge, and a heat source configured to direct heat to a region adjacent the cutting edge. The heat source has a head portion which sits below the cutting blade. Pulling the cutting edge across a material to be cut allows heat from said heat source to be directed to the material to be cut to soften the material prior to cutting.

12 Claims, 6 Drawing Sheets

HEATED UTILITY KNIFE

CROSS-REFERENCE TO RELATED APPLICATIONS

This application claims the benefit of U.S. Provisional Patent Application Ser. No. 61/709,590, filed on Oct. 4, 2012, incorporated herein in its entirety by reference.

STATEMENT REGARDING FEDERALLY-SPONSORED RESEARCH OR DEVELOPMENT

Not Applicable

BACKGROUND OF THE INVENTION

1. Field of Invention

The present general inventive concept relates to cutting tools, and more particularly to an apparatus designed to allow simultaneous, or near simultaneous, heating and cutting of a material.

2. Description of the Related Art

In various industries, the use of knives, such as for example utility knives, hook knives, etc. (hereinafter "knives") to cut material is known. For example, in the roofing industry, a hand-held knife is often used to cut one or more roofing shingles to a desired shape, for example to separate joined shingles for use in fabricating a ridge portion of a roof, or to shape a shingle to allow the shingle to fit around pre-existing structures on the roof. Following cutting of the shingle, the shingle may be installed in a desired location on the roof.

Many types of roofing shingles are fabricated from materials which are easier to cut at higher temperatures. For example, traditional asphalt roofing shingles tend to be stiffer and tougher, and therefore more difficult to cut, at colder temperatures. Conversely, these traditional asphalt roofing shingles tend to be more flexible, and therefore easier to cut, at warmer temperatures. Accordingly, because roof installation is typically performed in an outdoor environment, the ease at which a roofer may cut a shingle using a hand-held knife is often dependent, at least in part, upon the weather conditions in which the roofing takes place. More specifically, it is often easier to cut a shingle in an outdoor environment using a hand-held knife during warmer weather than it is to cut a similar shingle using a similar knife in colder weather, due to the respective relative temperatures of the shingles in such weather.

Similarly, in the flooring industry, hand-held knives are often used to cut flooring, such as for example carpet, vinyl flooring, linoleum, etc. (hereinafter "flooring") to a desired shape allow the flooring to be installed within the confines of a specific location. And, similarly to the above-discussed roofing shingles, many types of flooring are easier to cut at warmer temperatures and can be more difficult to cut at cooler temperatures.

When cutting a material whose shear strength is largely dependent upon temperature, such as the above-discussed flooring and roofing materials, in a cooler environment, it is often impractical to relocate the material to be cut to a warmer environment to allow the material to warm up, thereby softening the material for cutting. For example, when cutting the above-discussed roofing shingles in a cold outdoor environment, it is often impractical to relocate the shingles to be cut to a warmer environment prior to cutting the shingles. Likewise, when cutting a flooring material in a cool indoor environment, it is difficult to relocate the flooring material to a warmer environment prior to cutting. Accordingly, there is a need for a device which allows a material to be heated just prior to cutting the material, such that the material is softened by heat prior to cutting.

BRIEF SUMMARY OF THE INVENTION

According to several features of the present general inventive concept, a heated utility knife is provided for heating a material to be cut in order to soften the material before cutting the material. The heated utility knife may comprise a knife portion defining a distal cutting edge and a heat source configured to direct heat to a region adjacent the cutting edge. Thus, pulling the cutting edge across a material to be cut may allow heat from the heat source to be directed to the material to be cut to soften the material prior to cutting.

The knife portion may further comprise an elongate upper housing having a forward end and opposite rearward end, with the cutting edge extending from the forward end. In certain embodiments, the knife portion may further comprise a cutting blade defining the cutting edge, with the cutting blade being secured to the upper housing forward end. In certain embodiments, the knife portion may be retractable within and extendable from a slotted cavity defined by the upper housing. In certain embodiments, the knife portion may further comprise a slidable switch mounted along an upper side of the upper housing, with the slidable switch being in operative engagement with a mounting apparatus mounting the cutting blade to the upper housing, and with the slidable switch being adjustable between a first position, in which a distal point of the cutting blade is extended from the slotted cavity, and a second position, in which the distal point of the cutting blade is retracted into the slotted cavity. In certain embodiments, a compartment may be defined along a side surface of the upper housing. The compartment may be sized and shaped to carry therein at least one replacement cutting blade.

The heat source may comprise a blowtorch. In certain embodiments, the heat source may comprise a head portion disposed along a lower surface of the upper housing. The head portion may have a nozzle oriented to direct a flame to an area proximate the upper housing forward end, adjacent the cutting edge. In certain embodiments, the heat source may further comprise a reservoir configured to carry a measure of fuel therein. The reservoir may be capable of being placed in fluid communication with the head portion to supply fuel to the head portion for production of heat by the heat source. In some embodiments, the heat source may further comprise an igniter configured to provide ignition to fuel supplied to the head portion. In some embodiments, the heat source may further comprise at least one control switch configured to regulate the flow of fuel supplied to the head portion.

The heated utility knife may further comprise a lower housing fixed to the upper housing rearward end, with the lower housing being configured to contain the reservoir therein. The lower housing may define a handle for the heated utility knife. The lower housing may extend rearward of the upper housing at an angle slightly downward of a long dimension of the upper housing. The heated utility knife may further comprise a trigger device disposed along the lower housing in operative engagement with the igniter and the at least one control switch. Thus, depression of the trigger device may actuate the at least one control switch to allow fuel to flow from the reservoir to the head portion and may further actuate the igniter to ignite the fuel flowing to the head portion. The heated utility knife may further comprise a safety lock in operative communication with the trigger device to limit depression of the trigger device absent actuation of the safety lock. The heated utility knife may further comprise a wheel control provided along the lower housing proximate the trigger device. The wheel control may be configured to allow adjustment of a rate of flow of fuel from the reservoir to the head portion. In certain embodiments, the fuel may be butane.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
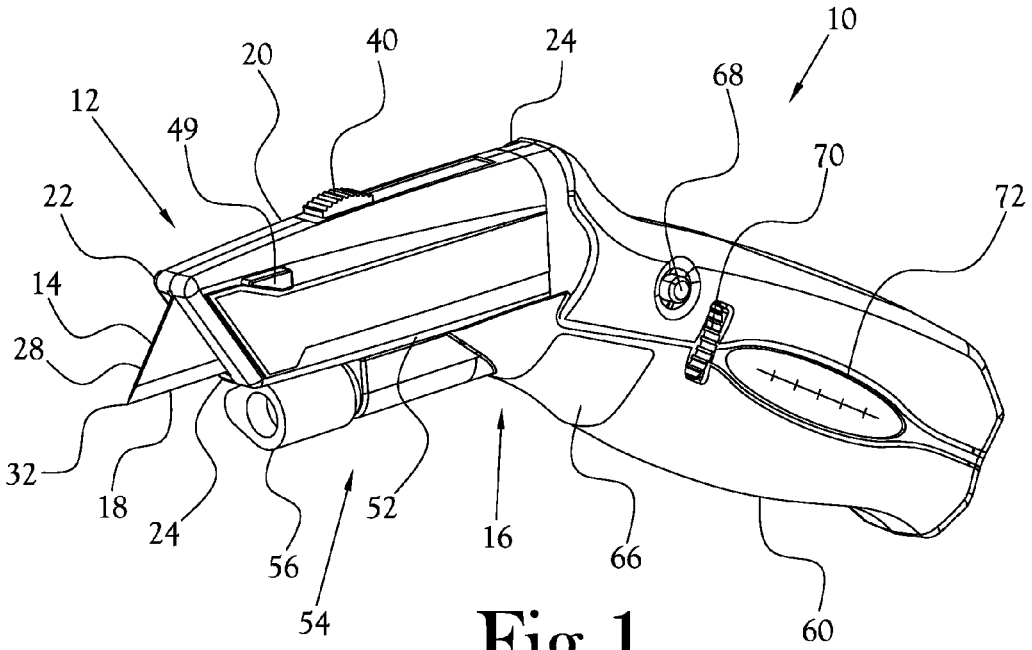
FIG. 1 is a perspective view showing one embodiment of a heated utility knife constructed in accordance with several features of the present general inventive concept.

Reference will now be made to various example embodiments of the present general inventive concept, examples of which are illustrated in the accompanying drawings and illustrations. The example embodiments are described herein in order to explain the present general inventive concept by referring to the figures. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The described progression of operations described are merely examples, however, and the sequence of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper," "forward," "rearward," and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to several features of the present general inventive concept, a heated utility knife is provided which allows a material to be heated contemporaneously with, or just prior to, cutting the material, such that the material may be softened by heat prior to and/or during cutting. One embodiment of a heated utility knife is disclosed generally at 10 in the accompanying figures. With reference to the figures generally, and in particular with reference to FIG. 1, the heated utility knife 10 includes a knife portion 12 having a cutting blade 14 extending generally forwardly therefrom. A heat source 16 is provided proximate a cutting edge 18 of the cutting blade 14 and is configured to direct heat energy to a region proximate the cutting edge 18 of the blade 14. Thus, as the cutting edge 18 of the blade 14 is brought into proximity with a material to be cut, a portion of the material before the cutting edge 18 of the blade 14 is subjected to heat energy from the heat source 16.

Figure 2:
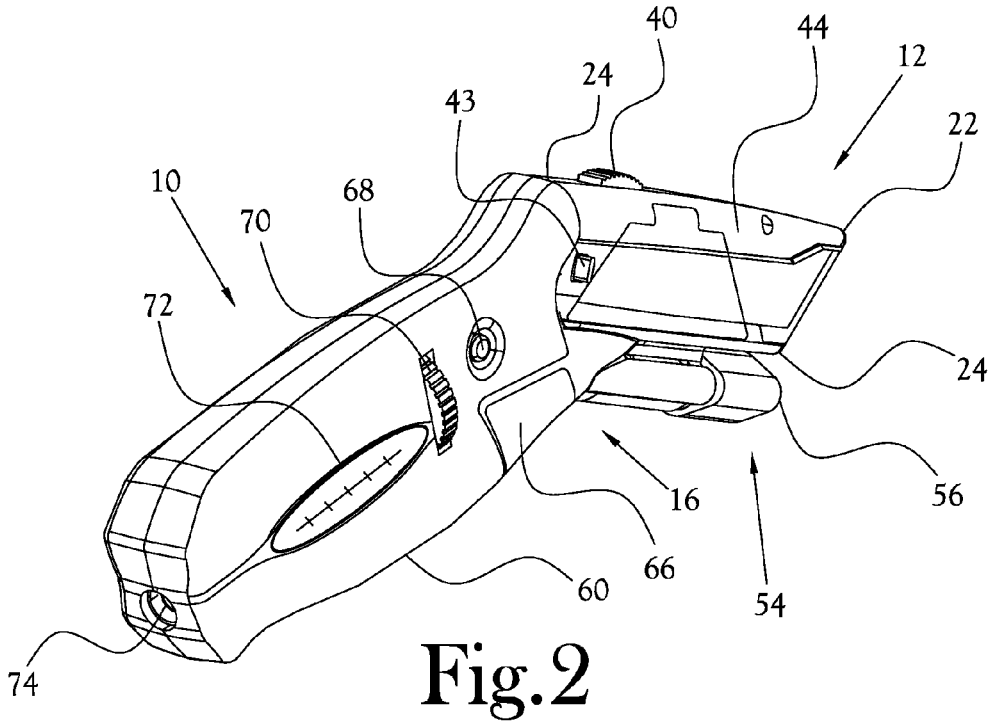
FIG. 2 is a perspective view showing an opposite side of the heated utility knife of FIG. 1.

FIGS. 1 and 2 illustrate left and right side perspective views of one embodiment of the heated utility knife 10. As shown in FIG. 1, in one embodiment, the knife portion 12 includes a substantially elongate upper housing 20 having a forward end 22 and an opposite rearward end 24. The upper housing 20 defines a substantially elongate, slotted cavity 24 which extends the length of the upper housing 20 and which opens to the forward end 22 of the upper housing 20. The slotted cavity 24 is sized and shaped to at least partially receive a rearward portion of a cutting blade 14 therein, such that a forward portion of the cutting blade 14 extends from the forward end 22 of the upper housing 20. In the illustrated embodiment, a trapezoid-shaped cutting blade 14 is provided which is sized and shaped to be secured to the upper housing 20 and slidably received within the slotted cavity 24. The cutting blade 14 has a lower cutting edge 18 extending generally parallel to a long dimension of the slotted cavity 24 and a non-sharpened upper edge 26 extending generally parallel to the lower cutting edge 18. Forward and rearward side edges 28, 30 of the cutting blade 14 extend from respective distal ends of the upper edge 26 in a tapered orientation toward the lower cutting edge 18 to define a distal point 32 of the cutting blade 14 at an intersection of the cutting edge 18 with the forward side edge 28 and a proximal point 34 at an intersection of the cutting edge 18 with the rearward side edge 30.

In several embodiments, the knife portion 12 defines characteristics similar to those of a retracting utility knife. For example, and with additional reference to FIGS. 3-5, the cutting blade 14 defines a plurality of indents 36 which are configured to be engaged by a carriage device 38 disposed within the slotted cavity 24. The carriage device 38 is, in turn, slidably mounted within the slotted cavity 24 and in operable engagement with a slidable switch 40 mounted along an upper side of the upper housing 20, such that the slidable switch 40 may be slid forward along the upper housing 20 to extend the distal point 32 of the cutting blade 14 from the slotted cavity 24 (see FIG. 1) and rearward along the upper housing 20 to retract the distal point 32 of the cutting blade 14 into the slotted cavity 24 (see FIG. 2). In several embodiments, a suitable locking mechanism, such as for example an internal latch, spring-loaded locking mechanism, frictional connection, etc., is provided to releasably secure the slidable switch 40 and associated cutting blade 14 in an extended position.

In the present embodiment, the above-discussed slidable switch 40 allows the cutting blade 14 to be selectively extended from and retracted into the upper housing 20. Thus, the cutting edge 18 of the blade may be exposed to allow use of the knife portion 12 and covered by the upper housing 20 to allow for safe storage and/or transportation of the heated utility knife 10 when not in use. However, it will be understood that the knife portion 12 may embody other characteristics of a cutting tool without departing from the spirit and scope of the present general inventive concept. For example, in other embodiments, the cutting blade 14 may embody different shapes, including but not limited to a hook blade, rectangular razor blade, straightback blade, trailing-point blade, clip-point blade, drop-point blade, spear-point blade, needle-point blade, spay-point blade, chisel-point blade, sheepsfoot blade, fan-blade, etc., without departing from the spirit and scope of the present general inventive concept. In some embodiments, the blade 14 may be fixed in relation to the upper housing 20, or in other embodiments rotatably mounted to the forward end 22 of the upper housing 20 and securable in a configuration extending from the forward end 22 of the upper housing 20 by a locking mechanism, without departing from the spirit and scope of the present general inventive concept.

Figure 3:
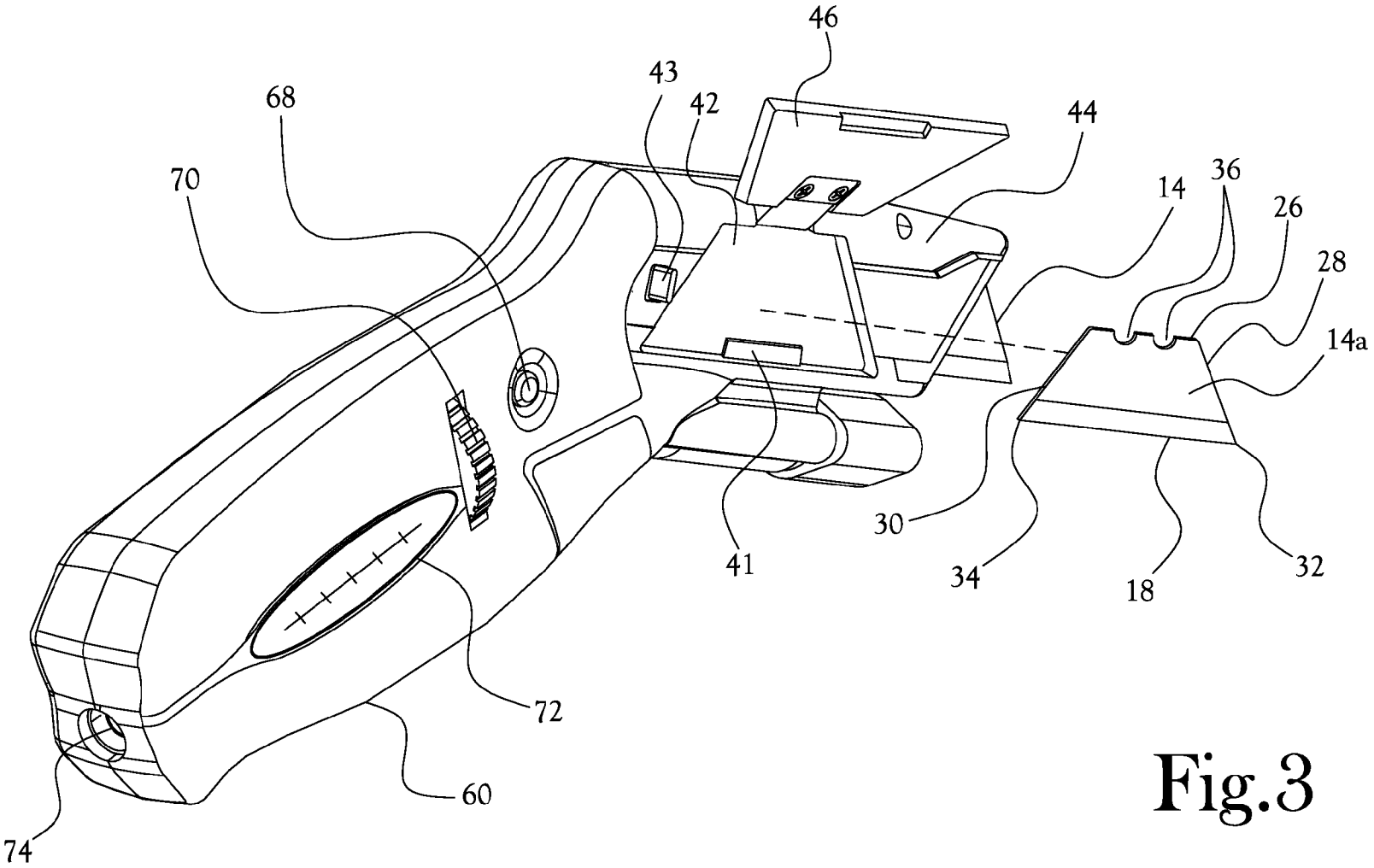
FIG. 3 is a partially-exploded perspective view of the heated utility knife of FIG. 1, showing the compartment and replacement blade.
Figure 4:
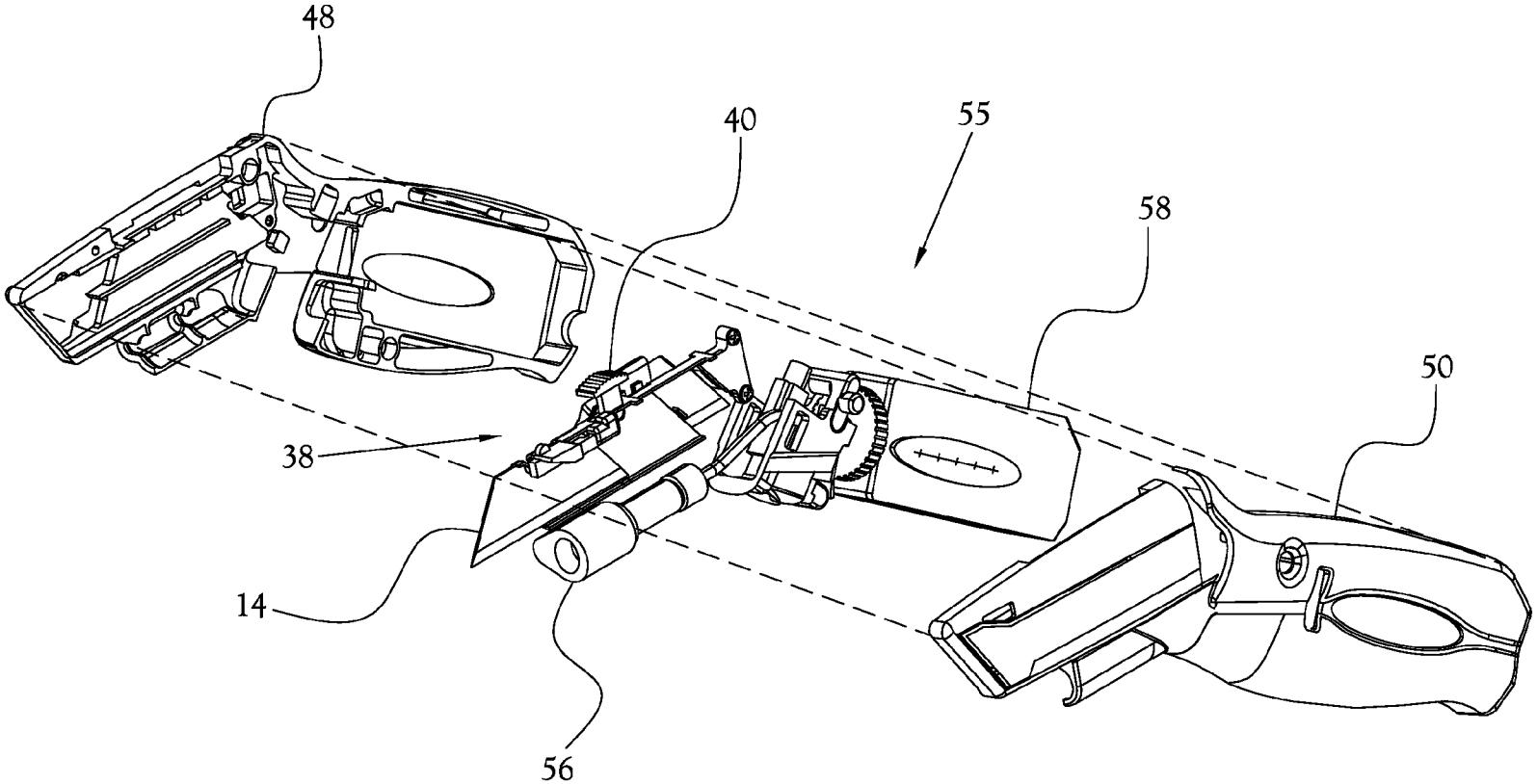
FIG. 4 is a partially-exploded perspective view of the heated utility knife of FIG. 1, showing the internal components of the heated utility knife

Referring to FIG. 3, in the illustrated embodiment, a compartment 42 is defined along an exterior side surface 44 of the upper housing 20. The compartment 42 is sized and shaped to receive and store therein one or more replacement cutting blades 14*a*, which may be used to replace the cutting blade 14 received within the slotted cavity 24. In the illustrated embodiment, a hinged door 46 is provided to selectively close access to the compartment 42, thereby assisting in retaining the replacement blades 14*a* stored within the compartment 42. In the illustrated embodiment, the hinged door 46 is spring biased toward an open position and is releasably fastened in a closed position by a suitable latch 41. The latch 41 is, in turn, in operable communication with a door release control 43 disposed along an exterior of the upper housing portion 20, such that actuation of the door release control 43 serves to disengage the latch 41, thereby allowing the door 46 to open and allow access to the compartment 42. It will be understood that other suitable devices and configurations exist to accomplish provision and operation of the compartment 42 containing the replacement blades 14*a* and the door 46, and such other suitable devices and configurations may be used without departing from the spirit and scope of the present general inventive concept. Furthermore, it will be understood that inclusion of the compartment 42 containing the replacement blades 14*a* and the door 46, while convenient to facilitate storage of replacement cutting blades 14*a*, is not necessary to accomplish the present general inventive concept.

In several embodiments, the upper housing 20 is defined by multiple component pieces secured to one another by suitable fasteners and/or latches. For example, in the illustrated embodiment of FIG. 4, the upper housing 20 and lower housing 60 (discussed in further detail below) portions of the heat source 16 are defined by first and second side component members 48, 50. These side component members 48, 50 may be joined together to form the upper housing 20 and other portions of the heated utility knife 10, to define the slotted cavity 24 therebetween, and to house various internal components 55 of the heated utility knife 10. In certain embodiments, the side component members 48, 50 may be selectively separated from one another to allow for at least partial disassembly of the upper housing 20, thereby allowing access to the interior slotted cavity 24 to facilitate replacement of the cutting blade 14. In other embodiments, such as the illustrated embodiment, a blade release control 49 is provided along the upper housing 20 to allow for selective release of the cutting blade 14 from the carriage device 38 and to allow for selective engagement of the cutting blade 14 by the carriage device 38. Thus, upon actuation of the blade release control 49, the cutting blade 14 may be removed from the slotted cavity 24 and replaced with a replacement cutting blade 14*a*. Upon positioning of the replacement cutting blade 14*a* within the slotted cavity 24, actuation of the blade release control 49 may be discontinued, whereupon the replacement cutting blade 14*a* is engaged by the carriage device 38.

Figure 5:
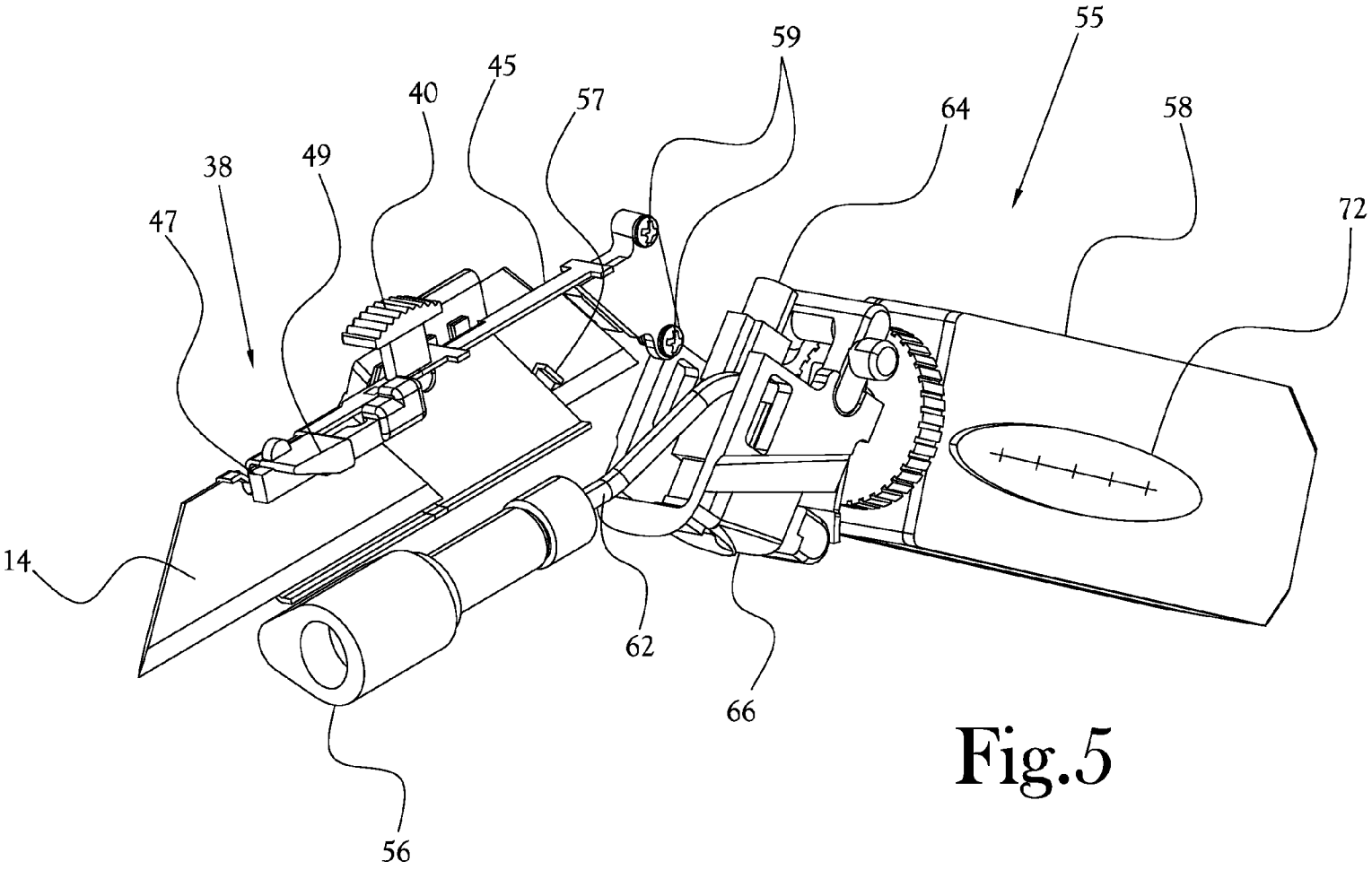
FIG. 5 is a perspective view of the internal components of the heated utility knife of FIG. 4.

FIG. 5 is a perspective view showing the internal components 55 of the heated utility knife 10, absent the side component members 48, 50 forming the upper housing 20. As shown in FIG. 5, in the illustrated embodiment, the slidable switch 40 is slidably mounted along a track 45, which is in turn mounted along an upper surface of the upper housing 20. The slidable switch 40 is mounted in a fixed relationship with a clamping mechanism 47 configured to engage the cutting blade 14 proximate the indents 36 when the blade release control 49 is in a non-actuated position. At least one stop 57 is provided in fixed relationship with the slidable switch 40 and the clamping mechanism 47 along the rearward side edge 30 of the cutting blade 14 to maintain the cutting edge 18 of the cutting blade 14 in generally parallel alignment with the long dimension of the slotted cavity 24 throughout movement of the cutting blade 14 between the extended and retracted positions along the track 45. In the illustrated embodiment, a plurality of fasteners 59 are provided to secure the track 45 to an internal surface of the side component members 48, 50 forming the upper housing 20. However, one of skill in the art will recognize other devices and configurations which may be used to slidably mount the cutting blade 14 along the slotted cavity 24, and such devices and configurations may be used without departing from the spirit and scope of the present general inventive concept.

Referring to FIGS. 1-5, according to several features of the present general concept, a heat source 16 is provided proximate the cutting edge 18 of the cutting blade 14 which is configured to direct heat energy to a region including and/or adjacent to the cutting edge 18 of the cutting blade 14. In the illustrated embodiment, the heat source 16 is defined by a flame torch having a head portion 54 disposed along a lower side 52 of the upper housing 20. As shown in FIG. 5, the heat source 16 is fixed to the upper housing 20. The head portion 54 is oriented to produce and direct a flame to an area proximate the upper housing forward end 22, adjacent the cutting edge 18 of the cutting blade 14 when the blade is in an extended position. In several embodiments, the torch is a blowtorch of the type configured to produce a relatively short, linear flame of approximately the same or slightly longer length than the portion of the cutting edge 18 extendable from the upper housing forward end 22. The head portion 54 includes a nozzle 56 which extends generally parallel to the lower cutting edge 18 of the cutting blade 14 along the lower side 52 of the upper housing 20, and defines generally the direction at which the flame is produced. In the illustrated embodiment, the torch is a butane torch. However, those of skill in the art will recognize other types of torches which may be used to direct heat to an area proximate the upper housing forward end 22, and such devices may be used without departing from the spirit and scope of the present general inventive concept.

In several embodiments, the heat source 16 of the heated utility knife 10 further includes a fuel source to supply a combustible fuel for use in the production of heat. For example, in the illustrated embodiment, a lower housing 60 is provided adjacent to, and in a fixed relationship with, the upper housing rearward end 24. The lower housing 60 is generally sized, shaped, and oriented in relation to the upper housing 20 such that the lower housing 60 may be used as a handle for the heated utility knife 10. In the illustrated embodiment, the lower housing 60 extends rearward of the upper housing 20 at an angle slightly downward of a long dimension of the upper housing. The lower housing 60 is further sized and shaped to carry a reservoir 58 which is adapted to store a measure of combustible fuel and to supply such fuel to the head portion 54 for use in the production of the above-discussed flame. The head portion 54 of the torch is in fluid communication with the fuel reservoir 58 via at least one conduit 62. In several embodiments, a trigger device 66 is provided along the lower housing 60 proximate an intersection of the lower housing 60 with the upper housing 20. The trigger device 66 is configured to regulate flow of fuel through the conduit 62 from the fuel reservoir 58 and to initiate the production of flame or other heat by the heat source 16.

Figure 6:
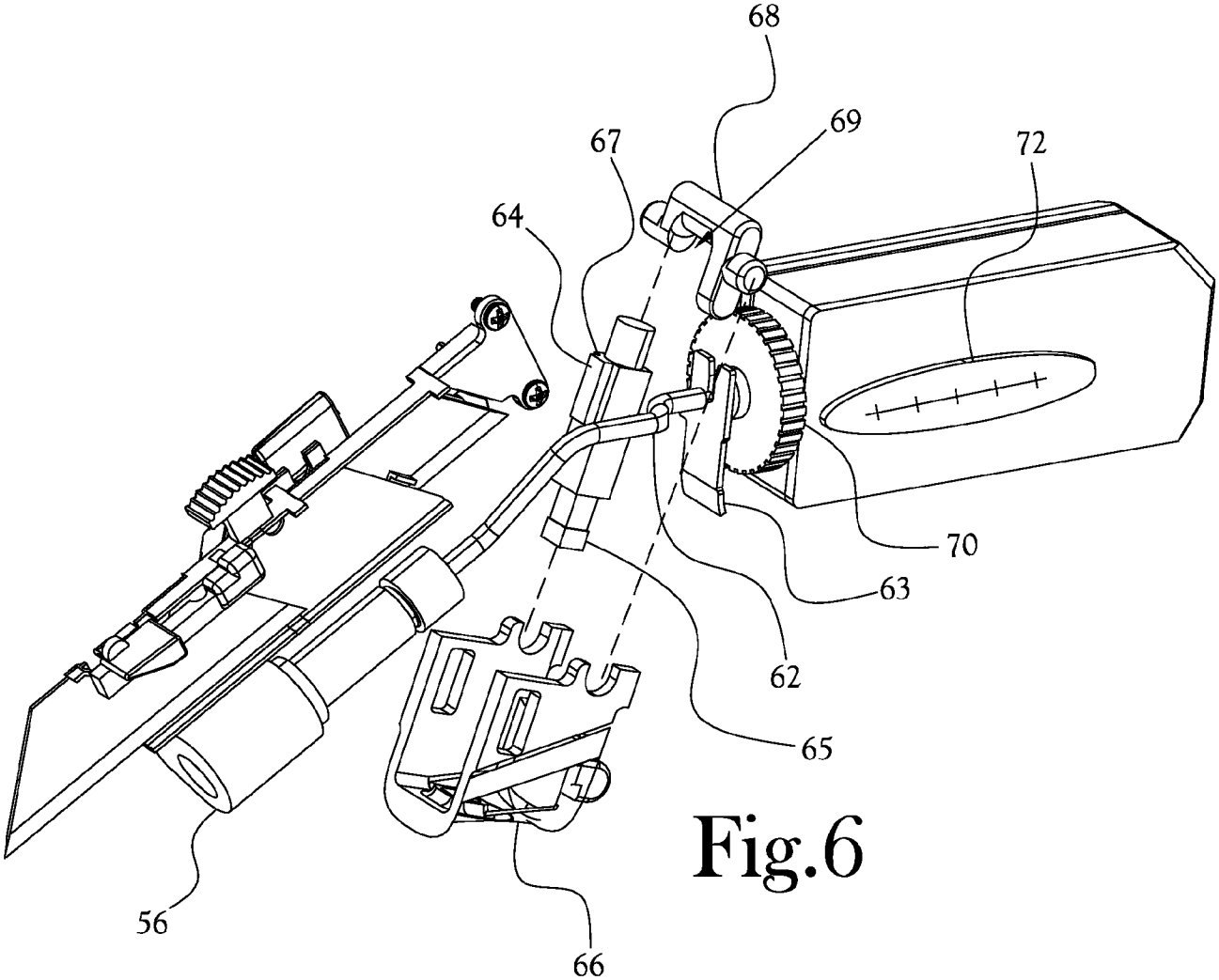
FIG. 6 is a partially-exploded perspective view of the internal components of the heated utility knife of FIG. 5.

FIG. 6 is a partially exploded perspective view showing the internal component 55 portions of the heated utility knife 10. As shown in FIG. 6, in the present embodiment, an igniter 64 is provided in communication with fuel moving through the conduit 62 and/or head portion 54 of the heat source 16. The igniter 64 is configured to provide an ignition to fuel carried from the reservoir 58 to the head portion 54, thereby allowing heat to be produced at the head portion 54. In the illustrated embodiment, the igniter 64 includes a plunger 65 which is slidable along the igniter 64 toward an end 67 of the igniter 64 opposite the trigger device 66 to actuate the igniter to produce the ignition. A control switch 63 is provided to control the flow of fuel through the conduit 62. In the illustrated embodiment, the control switch 63 is defined by a lever device which is configured to actuate a flow valve disposed at an interface of the conduit 62 with the reservoir 58. In this embodiment, the trigger device 66 is in operative communication with both the control switch 63 and the igniter 64, such that depression of the trigger device 66 results in depression of both the control switch 63 and the plunger 65 of the igniter 64 so as to simultaneously, or near simultaneously, allow fuel to flow from the reservoir 58 to the head portion 54 and ignite the fuel to allow the head portion 54 to produce and direct a flame to the area adjacent the cutting edge 18. Release of the trigger device 66 serves to disallow fuel flow to the head portion 54, thereby discontinuing production and direction of heat along the area adjacent the cutting edge 18, and to allow the plunger 65 to reset to a ready position.

In the illustrated embodiment, a safety lock 68 is provided in operative communication with the trigger device 66 to limit inadvertent depression of the trigger device 66. Specifically, in the illustrated embodiment, the safety lock 68 includes a substantially rigid member extending across a width of the heated utility knife 10. The safety lock 68 is biased toward a released position which blocks depression of the plunger 65 in relation to the remainder of the igniter 64. However, the safety lock 68 is capable of being pushed by a user along the width of the heated utility knife 10 to a depressed position. The safety lock 68 defines a void space 69 that, in the released position, is maligned with the plunger 65, but which aligns with the plunger 65 in the depressed position of the safety lock 68 to allow depression of the plunger 65 in relation to the remainder of the igniter 64. Thus, the safety lock 68 is configured such that the safety lock 68 must be actuated and held in an actuated position in order to allow operative depression of the trigger device 66, igniter 64 and control switch 63. Thus, inadvertent or unwanted depression of the trigger device 66 may be prevented absent simultaneous depression of the safety lock 68. Furthermore, in the illustrated embodiment, an additional wheel control 70 is provided along the lower housing 60 proximate the trigger device 66 and safety lock 68 in operative communication with the control switch for allowing flow of fuel through the conduit 62 to the head portion 54. The wheel control is configured to allow adjustment of the rate of flow of fuel through the conduit 62 to the head portion 54, thereby adjusting the overall length, size, and/or intensity of the flame produced by the heat source 16.

As discussed above, the heat source 16 of the present embodiment includes a butane torch configured to provide a flame to a region generally adjacent to the cutting edge 18 of the cutting blade 14, so as to provide heat to a portion of material to be cut by the cutting edge 18. To this extent, in the illustrated embodiment, the fuel reservoir 58 is configured to hold and dispense a measure of butane fuel. In the several embodiments, the reservoir 58 defines at least one window 72, and preferably a window 72 on each of two opposite sides of the lower housing 60, to allow a user to visually inspect the contents of the reservoir 58 to monitor fuel levels within the reservoir 58. In the illustrated embodiment, suitable openings are provided through each of the first and second side component members 48, 50 forming the lower housing 60 to allow access to the windows 72, the wheel control 70, and the safety lock button 68 by a user. Furthermore, in the illustrated embodiment, a refilling valve 74 is provided at a rearward end of the lower housing 60 to allow a user to add additional fuel to the reservoir 58.

It will be understood that numerous other devices are suitable for use to accomplish the heat source 16 of the present general inventive concept. To this end, in one embodiment, the heat source 16 comprises an infrared heater configured to direct energy to the blade, and/or to a region generally adjacent to the cutting edge 18 of the cutting blade 14, such that the directed energy may warm a portion of material to be cut by the cutting edge 18. In another embodiment, the heat source 16 may comprise a device for emitting a stream of hot air proximate the cutting edge 18, such as a heat gun or similar device. In such embodiments, the lower housing 60 may house a battery or other suitable energy source to provide operative power to the heat source 16.

Figure 7B:
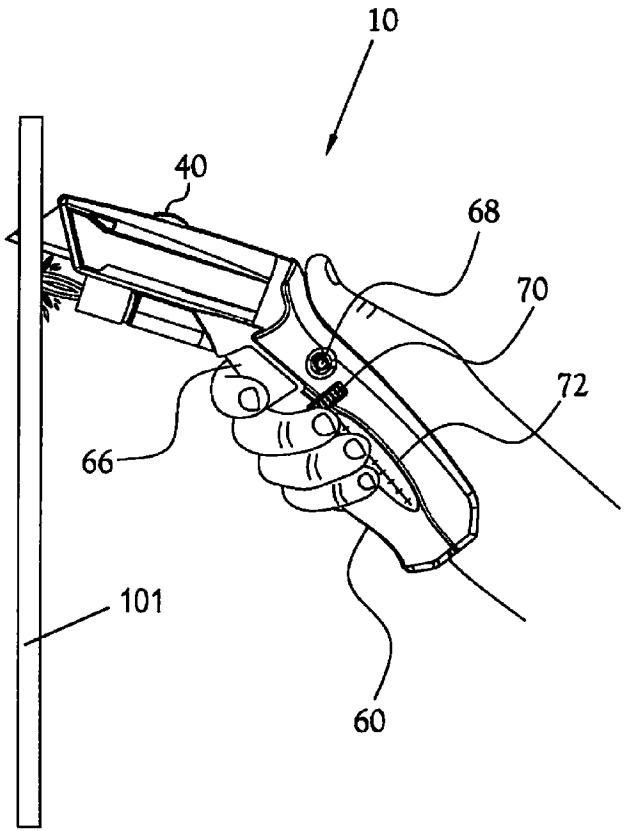
FIGS. 7A and 7B are side views showing use of the heated utility knife of FIG. 1.
Figure 7A:
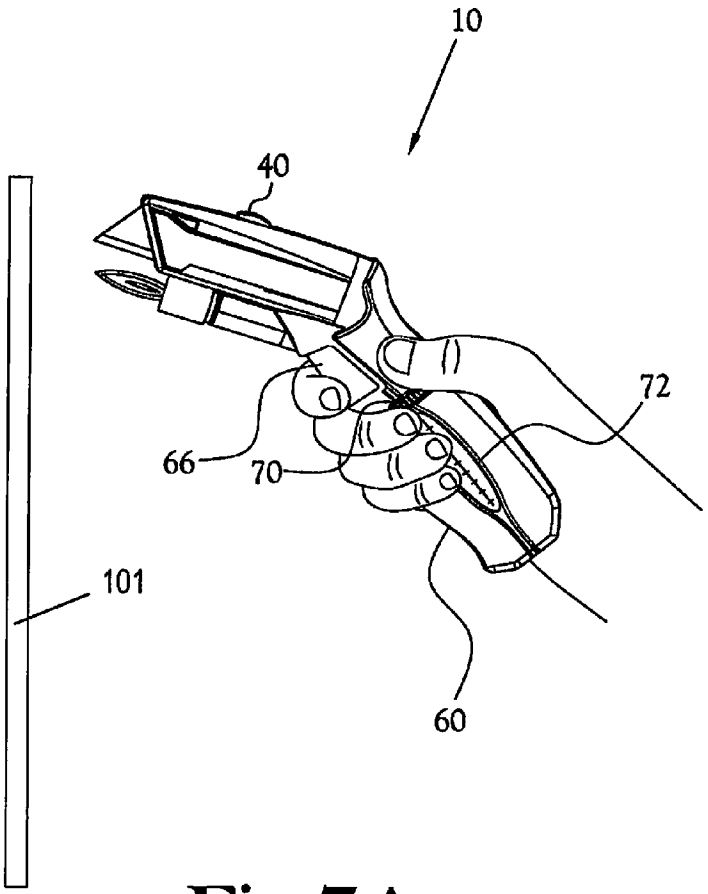

FIGS. 7A-7B illustrate one method of operation of the heated utility knife 10 to accomplish a method of cutting a planar material 101, such as for example a roofing shingle or sheet of flooring material. As shown in FIG. 7A, the present embodiment of the heated utility knife 10 may be used by first sliding the slidable switch 40 to a forward position, thereby extending a forward portion of the cutting blade 14 from within the slotted cavity 24. As discussed above, in several embodiments, the slidable switch 40 may be releasably locked in the forward position, thereby locking the cutting blade 14 in the forward position with a portion of the cutting edge 18 of the cutting blade 14 extending from the forward end 22 of the upper housing 20. Thereafter, the safety lock 68 may be depressed, and while the safety lock 68 is held in a depressed position, the trigger device 66 may be depressed, thereby activating the heat source 16 and directing heat to a region generally adjacent to the cutting edge 18 of the cutting blade 14.

As shown in FIG. 7B, the heated utility knife 10 may be held with the distal point 32 of the cutting blade 14 against a sheet of material 101 to be cut. In this configuration, the heat source 16 directs heat along the cutting edge 18 of the cutting blade 14 and to a portion of the material 101 to which the cutting edge 18 faces. Thus, the portion of the material 101 to which the cutting edge 18 faces is heated and softened. As the cutting edge 18 is pulled along the material 101, the cutting edge 18 cuts the softened portion of the material, whereupon subsequent portions of the material 101 are heated and softened by the heat source 16 prior to being cut by the cutting edge 18. Upon completion of a desired cut of the material 101, the trigger device 66 may be released, thereby deactivating the heat source 16 and discontinuing the production and direction of heat along the cutting edge 18. The slidable switch 40 may be released and moved to a retracted position, thereby retracting the cutting blade 14 within the slotted cavity 24 of the upper housing 20.

From the foregoing description, it will be recognized that a heated utility knife has been provided which is capable of heating a material to be cut in order to soften the material prior to cutting, and thereafter cutting the softened material. The heated utility knife provides a convenient tool to perform softening and cutting of a material in a single simultaneous operation, or in multiple near simultaneous operations. While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A heated utility knife for heating a material to be cut in order to soften the material before cutting the material, said heated utility knife comprising:

a knife portion comprising a cutting blade defining a distal cutting edge;

said cutting blade being retractable within and extendable from a slotted cavity defined by a housing comprised of an upper portion and lower portion;

a housing further comprising a first side component member and a second side component member;

and a heat source configured to direct heat a flame to a region adjacent and below said cutting blade, said heat source comprising a head portion disposed below said cutting blade;

said heat source further comprising a reservoir configured to carry a measure of combustible fuel therein, said reservoir being in intermittent fluid communication with said head portion to supply said fuel to said head portion for production of heat by said heat source;

said heat source further comprising at least one control switch configured to regulate the flow of combustible fuel supplied to said head portion, said control switch being integral to the housing;

said first and second component members being removably joined to surround and containing said knife portion, said heat source, said head portion, said at least one control switch, and said reservoir; and said head portion having a nozzle oriented to direct said flame to an area proximate said adjacent said cutting edge;

whereby pulling said cutting edge across a material to be cut allows heat from said heat source to be directed to the material to be cut to soften the material prior to cutting.

2. The heated utility knife of claim 1, said knife portion further comprising the upper portion having a forward end and opposite rearward end, said cutting edge extending from said forward end.

3. The heated utility knife of claim 2, said cutting blade being secured to said upper portion forward end.

4. The heated utility knife of claim 3, said knife portion further comprising a slidable switch mounted along an upper side of said upper portion, said slidable switch being in operative engagement with a mounting apparatus mounting said cutting blade to said upper portion, said slidable switch being adjustable between a first position in which a distal point of said cutting blade is extended from said slotted cavity and a second position in which said distal point of said cutting blade is retracted into said slotted cavity.

5. The heated utility knife of claim 4 further comprising a compartment defined along a side surface of said upper portion, said compartment being sized and shaped to carry therein at least one replacement cutting blade.

6. The heated utility knife of claim 1, said heat source further comprising an igniter configured to provide ignition to the fuel supplied to said head portion.

7. The heated utility knife of claim 6 wherein the heat source is a blowtorch.

8. The heated utility knife of claim 7, said housing defining a handle for said heated utility knife.

9. The heated utility knife of claim 8 further comprising a trigger device disposed along said housing in operative engagement with said igniter and said at least one control switch, whereby depression of said trigger device actuates said at least one control switch to allow the fuel to flow from said reservoir to said head portion and further actuates said igniter to ignite said fuel flowing to said head portion.

10. The heated utility knife of claim 9 further comprising a safety lock in operative communication with said trigger device to limit depression of said trigger device absent actuation of said safety lock.

11. The heated utility knife of claim 10 further comprising a wheel control provided along said lower portion proximate said trigger device, said wheel control being configured to allow adjustment of a rate of flow of the fuel from said reservoir to said head portion.

12. The heated utility knife of claim 7, said fuel being butane.

* * * * *